United States Patent [19]

Alich

[11] Patent Number: 4,817,407

[45] Date of Patent: Apr. 4, 1989

[54] ROLLING STAND

[76] Inventor: Günter Alich, Bernhofstrasse 51, 8134 Adliswil, Switzerland

[21] Appl. No.: 65,861

[22] Filed: Jun. 23, 1987

[30] Foreign Application Priority Data

Jul. 2, 1986 [CH] Switzerland ..... 2654/86

[51] Int. Cl.[4] ..... B21B 13/14; B21B 37/08

[52] U.S. Cl. ..... 72/8; 72/11; 72/20; 72/21; 72/245; 100/47; 100/162 B; 100/170

[58] Field of Search ..... 72/245, 243, 241, 237, 72/21, 8, 11, 20; 100/47, 170, 162 B

[56] References Cited

U.S. PATENT DOCUMENTS

| | | | |
|---|---|---|---|
| 3,373,588 | 3/1968 | Stone | 72/245 X |
| 3,394,566 | 7/1968 | O'Brien | 72/245 X |
| 3,448,683 | 6/1969 | Seanor et al. | 100/170 |
| 3,659,450 | 5/1972 | Metzger | 72/245 X |
| 3,803,866 | 4/1974 | Sterrett et al. | 72/245 X |
| 3,902,114 | 8/1975 | Alich | 72/21 X |
| 4,280,552 | 7/1981 | Bayer et al. | 72/245 X |

FOREIGN PATENT DOCUMENTS

| | | | |
|---|---|---|---|
| 2036826 | 12/1970 | France | 72/245 |
| 0018210 | 1/1985 | Japan | 72/245 |
| 0789178 | 12/1980 | U.S.S.R. | 72/245 |
| 747347 | 4/1956 | United Kingdom . | |
| 0952135 | 3/1964 | United Kingdom | 72/245 |
| 1133944 | 11/1968 | United Kingdom . | |

*Primary Examiner*—Robert L. Spruill
*Assistant Examiner*—Steven B. Katz
*Attorney, Agent, or Firm*—Henry M. Feiereisen

[57] ABSTRACT

A rolling stand includes a stationary roll and at least one movable roll in spaced-apart relationship with the journals of the movable roll supported in a bearing unit which cooperates with a control mechanism for radially displacing the movable roll relative to the stationary roll and thus for adjusting the gap therebetween. The bearing unit includes two separate radial bearings with one radial bearing cooperating with a control element and with the other radial bearing acted upon by a work element which applies a counterforce in opposition to the force exerted by the control element.

16 Claims, 4 Drawing Sheets

ROLLING STAND

BACKGROUND OF THE INVENTION

The present invention refers to a rolling stand, and in particular to a coating unit with a stationary roll and at least one movable roll whose roll necks are supported in a bearing unit which cooperates with a control mechanism for radially displacing the movable roll relative to the stationary roll and thus for adjusting the gap therebetween.

The manufacture and refining of foils or webs by means of rolling mills e.g. for rolling of metal foils and plastic foils, coating of foils and strips by using calender or coating units rolls, frequently demands that the spacing between the rolls and thus the gap width be accurately maintained to attain a uniform product of equal thickness. In addition, economical reasons require during rolling operation and in particular during application of expensive coatings to operate at the lower tolerance limit of the guaranteed thickness so as to save material.

To meet these demands, the use of highly sophisticated control mechanisms were proposed in order to compensate non-circular or eccentric rolls during running of the latter in addition to precise and expensive bearings for the journals of the rolls. Such bearings were considered necessary as even a small bearing play should be avoided in the event the foil or solvent advancing through the roller gap exerts only relatively small reaction forces as this is the case during production of plastic foils or coating foils with the aid of a (third) doctor roll, so that the solvent e.g. for carbon film, is pre-metered by the doctor and contra-rotating rolls. Especially when treating solvents without foils of small thickness and thus requiring small gap widths, the demand o relatively high accuracy with deviations of less than 1 micrometer reaches the limits of providing suitable bearings.

There are known rolling mills in which the housing is mechanically or hydraulically prestressed e.g. by interposing pressure elements or hydraulic cylinders between the roll chocks, in order to compensate changes of the gap width which are caused through load variations in the roller gap. However, this method for prestressing the housing as used for metal rolling mills is not suitable for coating units because there are practically no reactions forces exerted thereon. Apart from that, this prestressing method for the housing is still not able to maintain the accuracy of the gap width between the rolls.

SUMMARY OF THE INVENTION

It is thus a principal object of the present invention to provide an improved rolling stand obviating the aforestated drawbacks.

This object and others which will become apparent hereinafter are attained by supporting each side of the movable roll by a pair of separate radial bearings arranged adjacent to each other with one radial bearing acted upon by a control element exerting a force in direction of adjustment and with the other radial bearing cooperating with a work element to exert a counterforce in opposition to the direction of adjustment.

Through the provision of such radial bearings, the movable roll is supported at each side thereof in a force-locking manner without any play so that an accurate adjustment of the rolls by the control element is possible in accordance with a command variable without any impairment of the support. Thus, the application of complicated and expensive bearings becomes unnecessary even though the material advanced between the rolls may not exert any reaction forces.

According to a further feature of the invention, the control element is represented by a double acting hydraulic control cylinder while the work element is defined by a mechanically prestressed elastic rod which exerts a counterforce increasing with diminishing gap width between the rolls. The use of a work element applying a counterforce in dependence on the gap width and prestressing the movable roll relative to said stationary roll has the advantage that a collision between the rolls and thus a destruction thereof is prevented when limiting the force exerted by the control element to a maximum value which corresponds to the counterforce applied y the work element so that a complete elimination of the gap width is prevented. The prevention of such collisions between the rolls could hardly be avoided e.g. by using a rigid stop for the support of the rolls when taking into account gap widths of a few micrometers as well as the small deformation forces of the material in the gap and when considering the eccentricities of the rolls and the temperature-dependent dimensional fluctuations of rolls and frame.

Even in the event extremely small roller gaps are required, a contact between the rolls and thus a destruction is still prevented especially when in accordance with a further feature of the present invention the control element cooperates with a pressure relief valve for limiting the pressure supply.

Advantageously, the control element and the work element are arranged at the same side of the gap so that temperature-dependent dimensional fluctuations of the roll bodies and roller frame remain without any disturbing influence.

Instead of their support by the housing frame, according to still another feature of the invention, the control element and the work element may be supported directly by the stationary roll and thus be effective directly between both rolls so that any deformations of the frame caused e.g. by deficient stiffness and/or temperature fluctuations cannot affect the adjustment of the gap.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
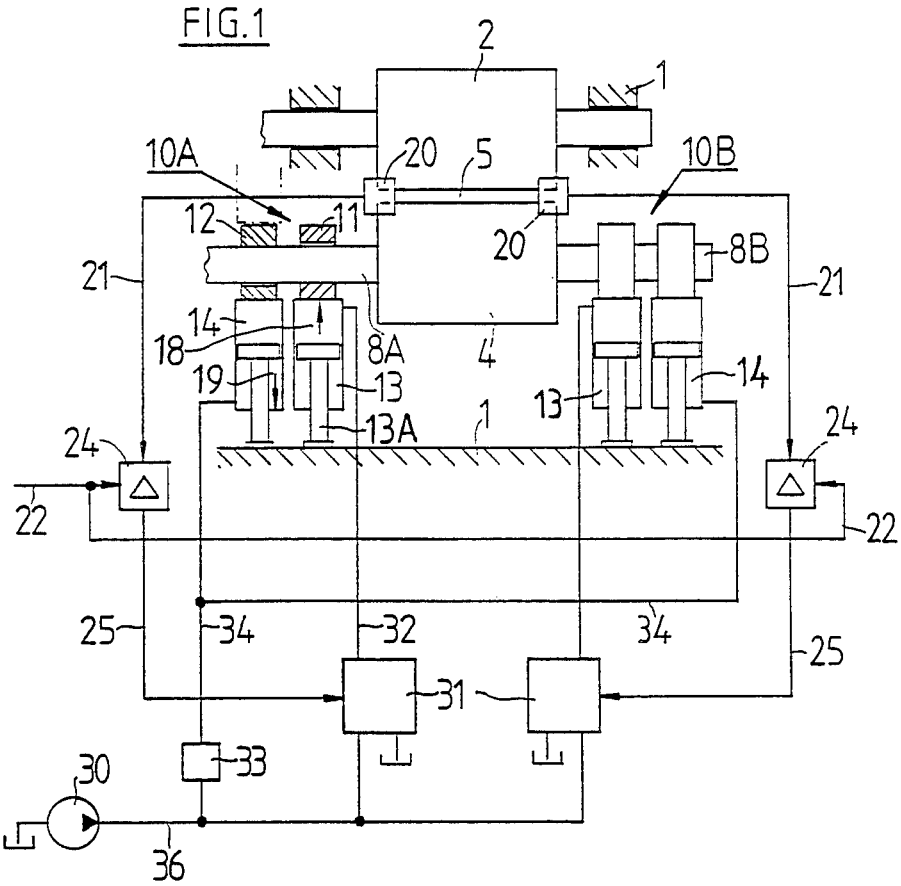
FIG. 1 is a schematic illustration of a first embodiment of a rolling stand in accordance with the invention depicting a pair of spaced apart rolls and a control unit for adjusting the gap between the rolls.
Figure 2:
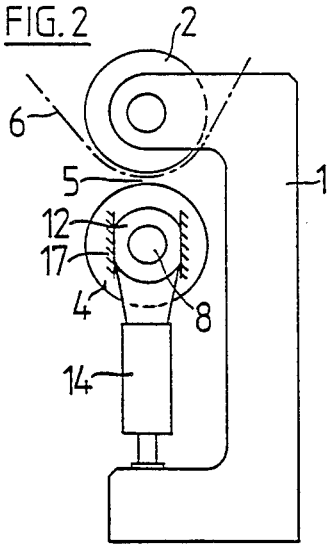
FIG. 2 is a schematic side view of the rolling stand of FIG. 1.

Referring now to the drawings, and in particular to FIGS. 1 and 2, there is schematically illustrated a part of a first embodiment of a rolling stand according to the invention which includes a pair of superimposed rolls 2 and 4 in spaced apart relationship to define a roller gap 5 therebetween through which a foil or web 6 (FIG. 2) is advanced. For matter of convenience of illustration, the drive for the rolls 2, 4 is not shown. The rolling mill according to the invention is used for finish-rolling of plastic foils or metal foils or may be a calender with calender rolls for refinishing, in particular for coating foils or webs. In any event, the rolling stand according to the invention is preferably applied for those circumstances in which a relatively narrow roller gap is to be maintained with extreme precision - in the range of micrometer - and wherein only small or no reaction forces (forces of deformation) are exerted by the foil or solvent onto the rolls.

As shown in FIG. 1, roll 2 is fixedly supported in a roll housing 1 which is only schematically indicated. Roll 4 is radially movable relative to roll 2 and includes a traversing shaft 8 whose journals 8A, 8B at each side of the roll 4 are guided in respective bearing units generally designated by reference numerals 10A, 10B. For adjusting the roll 4 in radial direction thereof, the bearing units 10A, 10B cooperate with a control mechanism which adjusts the position of the pertaining bearing unit 10A, 10B and thus of the roll 4. Since the bearing units 10A, 10B for the journals 8A, 8B at each side of the roll 4 are identical, the following description refers only to the bearing unit 10A depicted at the left hand side of FIG. 1.

The bearing unit 10A includes a pair of two separate radial bearings 11, 12 arranged adjacent to each other. At least one of the radial bearings 11, 12—e.g. the radial bearing 11 which is closer to the roll 4 as shown in the nonlimiting example of FIG. 1—is connected to a control element represented by a hydraulic control cylinder device 13 with reciprocating piston 13*a* so as to be displaceable in radial direction to shift the roll 4 relative to the roll 2 as indicated by arrow 18 (positive direction of adjustment). At least one of the radial bearings 11, 12 is guided in direction of adjustment in a bearing plate 17 which is schematically illustrated in FIG. 2 and is connected to the housing 1. It will be appreciated that any other suitable means for guiding the roll 4 should certainly be considered within the scope of the invention.

Acting on the radial bearing 12 is a work element 14 which is constituted by a hydraulic control cylinder device connected to the housing 1. The work element 14 exerts a force onto the radial bearing 12 as indicated by arrow 19 which opposes the force applied by the control element 13 to (positively) adjust the roll 4. Thus, the circle of forces during regulation of the roll 4 is provided by the connection of the control elements 13 and the work elements 14 with the housing 1.

Preferably, as depicted in the embodiment of the rolling mill of FIG. 1, the control element 13 and the work element 14 are arranged next to each other at the same side of the shaft 8 or gap 5 with the work element 14 exerting a continuous pulling action onto the bearing 12. As indicated in dash-dot line in FIG. 1, it is certainly feasible to arrange the work element 14 in opposite arrangement to the control element 13 in which case, the work element 14 exerts a pressure force onto the bearing 12 in order to oppose the force applied by the control element 13 onto the radial bearing 11. It should, however, be appreciated that the arrangement of the control element 13 and work element 14 at the same side has the advantage that the temperature-dependent dimensional fluctuations in the housing 1, on the one hand, and in the rolls 2, 4 and control mechanism, on the other hand, compensate each other and thus remain without any impact on the width of the gap 5 between the rolls 2, 4.

The rolling mill is preferably equipped with an automatic control mechanism (closed loop control) for adjusting the spacing between the rolls 2, 4 and thus of the width of the gap 5. Accordingly, the control element 13 at each side of the roll 4 communicates via a hydraulic control valve 31 and lines 32 and 36 with a pressure source 30 (hydraulic pump unit). The pressure source 30 is also in connection with the work elements 14 via a pressure regulator 33 and line 34. Arranged at each side between the rolls 2, 4 is a generator 20 for determining the spacing between the rolls 2, 4 and thus the width of gap 5. Each spacing measuring generator 20 provides a measuring signal which constitutes the actual value and is transmitted via a line 21 to a servo amplifier 24. In addition to the actual value, the servo amplifier 24 is supplied via a line 22 with an adjustable desired value signal so as to generate an output signal in dependence on the comparison of actual value and desired value which output signal is transmitted as regulating variable via a line 25 to the control valve 31.

By pressurizing the work element 14, a continuous counterforce to the regulating force of the control element 13 is exerted; however, the controlled regulating force is always of such magnitude so as to overcome the counterforce exerted by the work element 14. Consequently, as indicated at the left hand side in FIG. 1, a radial play in the form-fitting and force-locking bearing units as defined by the bearings 11, 12 is constantly eliminated in direction of adjustment so that an extremely accurate control mechanism for the gap width is obtained without necessitating the application of special bearings which are selected for being free of eccentricity and play and thus very expensive.

Figure 3:
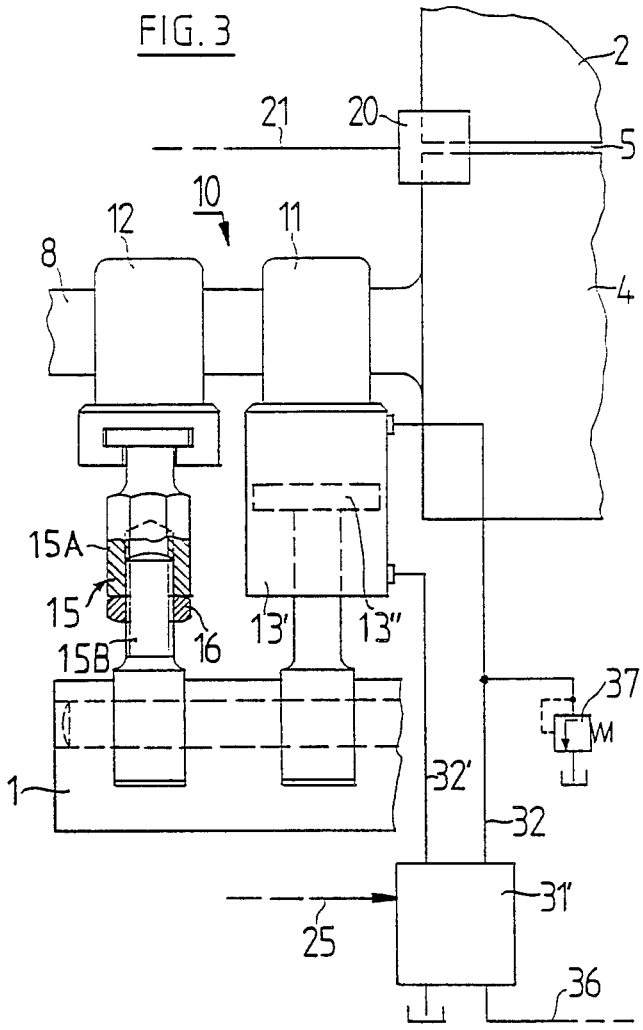
FIG. 3 is a partial schematic illustration of a second embodiment of a rolling stand in accordance with the invention.

Turning now to FIG. 3, there is shown schematically a second embodiment of a rolling stand according to the invention. For matter of convenience of illustration, the support of the journal 8 of the roll 4 is only shown at one side thereof because as already outlined with regard to the embodiment as shown in FIGS. 1 and 2, the supports of the journal 8 at each side of the roll 4 are identical. The stationary roll 2, too, is only partly indicated. Further, it will be recognized that those parts which correspond to equivalent parts in the embodiment of FIGS. 1 and 2 have been designated by same reference numerals.

Accordingly, the bearing unit generally designated by reference numeral 10 includes the radial bearing 11 which is connected to a control element 13′ represented by a double acting hydraulic control cylinder and connected to the housing 1. The control element 13′ accommodates a piston 13″ which reciprocates within the cylinder 13' and communicates via lines 32 and 32' with a control valve 31'. Line 32 communicates with the cylinder at one side of the piston 13" while line 32' opens into the cylinder at the other side thereof. During displacement in direction of positive adjustment, the pressure line 32 preferably cooperates with a pressure relief valve 37, the purpose of which will be described furtherbelow. The work element 14 connected to the bearing 12 is represented by a pulling or tie rod (expansion rod) 15 which is adapted for length adjustment. In the nonlimiting example of FIG. 3, the work element 14 includes two members screwed to each other with one member 15*a* being rotatably mounted to the bearing 12 and with the other member connected to the housing 1. A counternut 16 is provided for suitably adjusting the length during operation.

Of course, it will be recognized that the described embodiment of a length adjustable tie rod is selected only for purposes of illustrating the train of action of the arrangement. In order to obtain a convenient and precise adjustment of the length of the rod, an embodiment of a rolling stand is proposed in which the length adjustment is attained by using e.g. a frictionless, torque-free ball screw with remote controlled rotary drive and a gear box with self-locking mechanism to maintain the adjusted length of the rod.

Dimensioning of the mechanical tie rod 15 and selection of the basic setting of its length are such that at the maximal adjustable width of the gap 5 between the rolls 2, 4, the tie rod 15 is already prestressed by the control element 13' and is stressed in the elastic elongation area over the operational control range of the gap 5 (work range of the control and control element 13'). Thus, with reducing gap width, the pulling force by the rod 15 increasingly opposes the regulating force exerted by the control element 13'. It will be appreciated that the thus prestressed mechanical rod 15 provides a continuous compensation of play in the bearing unit 10 and achieves in cooperation with the control element 13' an unobjectionable, form-fitting and force-locking guidance of the journal 8 over the control range.

Figure 4:
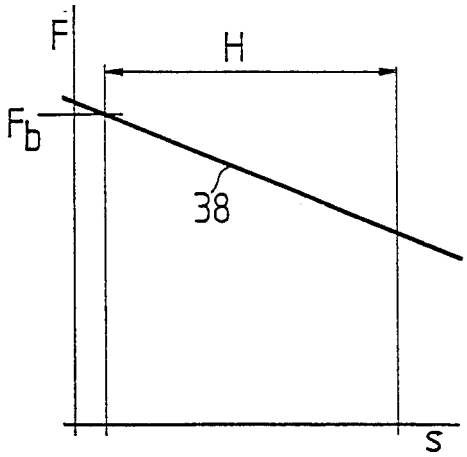
FIG. 4 is a graphical illustration for representation of a preferred operation of the rolling stand of FIG. 3.

Referring now to FIG. 4, there is illustrated a graphical illustration of the counterforce exerted by the work element 15 in dependence on the width of the roller gap 5, e.g. the "spring characteristic" according to the Hooke's law of an elastically expanded pulling rod. Reference numeral 38 represents the graph of the counterforce; H characterizes the operational working range of the control element 13' during regulation of a gap width s wherein the respectively adjusted position is altered during operation within this range by modifications of the desired value but also through disturbances like eccentricity or non-circular rolls during revolutions of the same. In the event of limiting the maximal possible regulating force of the control element 13' to a value $F_b$ which corresponds to the counterforce at still finite gap width s according to characteristic 38, it follows that the regulating range H is limited as well in direction of adjustment so that a complete elimination of the gap width and thus a dangerous colliding of the rolls are prevented.

A limitation of the controlling force exerted by the control element 13' according to FIG. 3 is obtained by the pressure relief valve 37 which communicates with the pressure line 32. Alternatively, it is certainly possible to provide a suitable pressure control mechanism within the pressure source (hydraulic pump). For suitably setting the arrangement, the rolls 2, 4 are first brought in a position in which the gap width s is at its narrowest, and then, the length of the tie rod 15 is adjusted at corresponding (according to the characteristic 38) mechanical prestress for a defined calibrating value.

Figure 6:
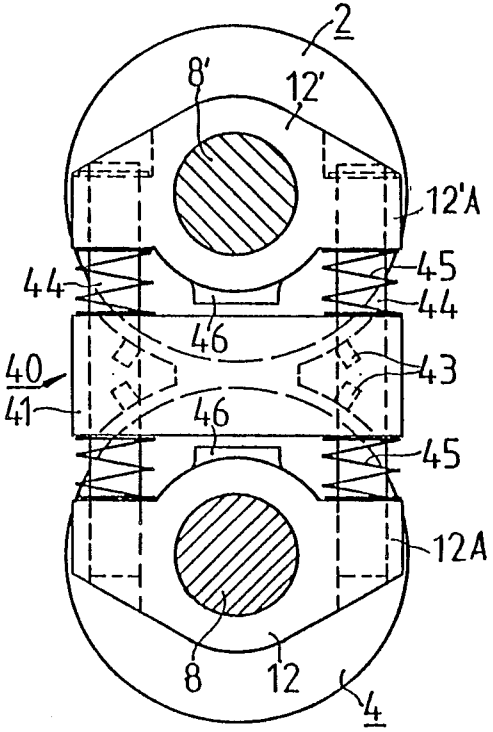
FIG. 6 is a partially sectional view of the rolling stand taken along the line VI—VI in FIG. 5.
Figure 5:
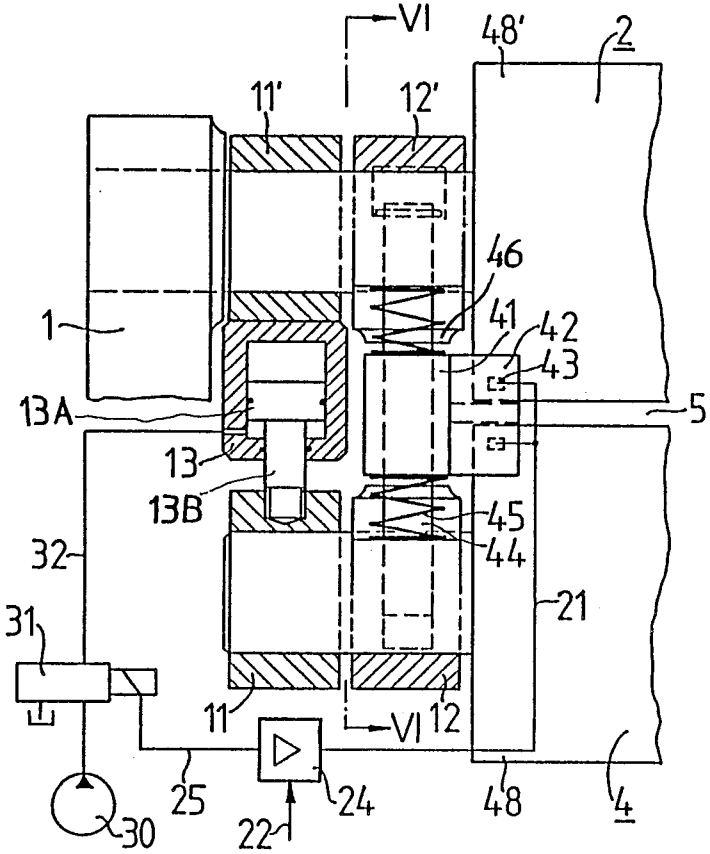
FIG. 5 is a partially sectional side view of a third embodiment of a rolling stand in accordance with the invention.

Turning now to FIGS. 5 and 6, there is illustrated a third embodiment of a rolling stand in accordance with the present invention wherein only the support of the rolls on the left hand side is shown for matter of convenience as the support on the other side is identical. In contrast to the previous embodiments, the roll 2 is now also supported by radial bearings as will be described hereinafter so as to render ineffective possible deficient stiffness of the housing 1 and/or temperature fluctuations, with regard to the adjustment of the gap.

Accordingly, each of the journals 8, 8' of the stationary and movable rolls 2, 4 is supported by two separate radial bearings 11', 12'; 11, 12. While the stationary roll 2 is still fixedly supported relative to the housing 1, the roll 4 is radially movable relative to the roll 2 for allowing the adjustment of the gap 5 and is not connected to the housing 1. In order to prevent any oscillating movements, the roll 4 may, however, be laterally guided e.g. via guidances mounted to the frame 1 at both sides of the bearing 11. For ease of illustration, the guidance of roll 4 has been omitted from FIGS. 5 and 6.

The control element 13 is constituted by a hydraulic control cylinder device with a cylinder 13*a* attached to the bearing 11' and with a piston rod 13*b* mounted to the bearing 11. The other pair of bearings 12, 12' is spring-biased by four compression springs 45 so as to oppose the force exerted by the control cylinder device 13 in adjusting direction and to continuously compensate any bearing play. The bearings 12, 12' are laterally provided with extensions 12*a*, 12*a*' between which two parallel guide bars 44 are arranged for guiding a support 40 in form of a crossbar 41. As is shown in FIG. 6, the compression springs 45 are retained along the guide bars 44 with one end abutting against the respective extension 12*a*, 12*a*' of the pertaining bearing 12, 12' and with the other end resting against the crossbar 41 so that the latter is approximately maintained at a central position between the rolls 2, 4.

Each bearing 12, 12' is further provided with a central stop member 46 facing the crossbar 41 in order to define the minimum spacing between the rolls 2, 4 and to prevent a collision of the latter during operation.

The crossbar 41 of support 40 is provided with two axial extensions 42 which project between the roll bodies 48, 48' of both rolls 2, 4 without contacting the same. Located on the extensions 42 are non-contacting probes 43 which deliver an electrical signal in dependence on the spacing to the roll body surface. In a manner known and described e.g. in U.S. Pat. No. 3,902,114, a signal corresponding to the spacing between the rolls 2, 4 and thus of the width of gap 5 can be derived from the individual signal as provided by the probes 43.

A control loop for automatic adjustment of the width of the gap 5 is illustrated only in schematic and simplified manner and corresponds essentially to the control loop as described in connection with FIG. 1. It can thus be readily recognized that the cylinder 13*a* of the control element 13 is connected via the hydraulic pressure line 32 and the control valve 31 to the pressure source 30. Acting on the control valve 31 is a servo or summation amplifier 24 which receives information from the probes 43 via line 21 and after comparison with a desired value supplied through line 22 delivers a regulating signal via line 25 to the control valve 31.

Figure 8:
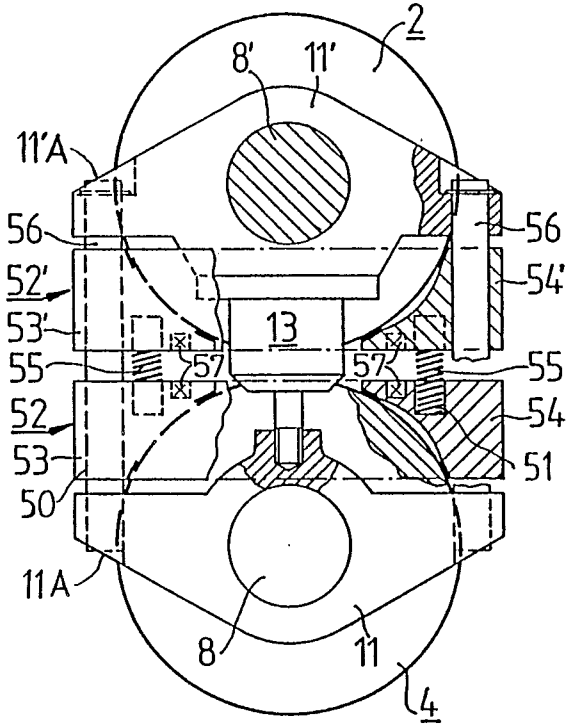
FIG. 8 is a partially sectional view of the rolling stand taken along the line VII—VII in FIG. 6.
Figure 7:
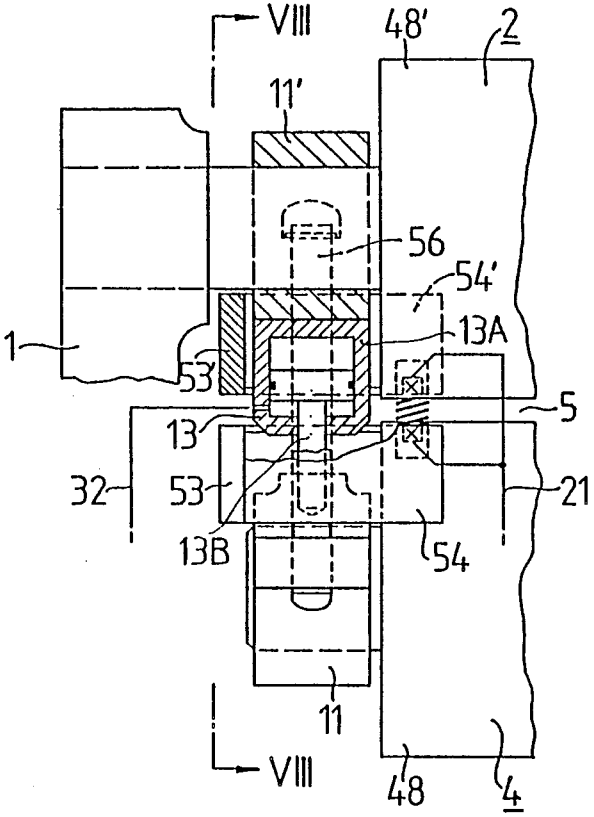
FIG. 7 is a partially sectional side view of a fourth embodiment of a rolling stand in accordance with the invention.

A further embodiment of a rolling mill in accordance with the present invention is illustrated in FIGS. 7 and 8 which also depicts only the support at the left hand side. As can be seen therefrom, the journals 8, 8' of the pertaining rolls 2, 4 are supported by only one pair of bearings. In the nonlimiting example of FIGS. 7 and 8 it is shown that the bearings 11, 11' support the journals 8, 8' and are acted upon by the control element 13 in a manner essentially corresponding as described with regard to FIG. 5. Thus, the control element 13 is a hydraulic control cylinder device with the cylinder 13*a* attached to the bearing 11' and the piston rod 13*b* fixed at the bearing 11. Each bearing 11, 11' is provided at each side with an extension 11*a*, 11*a'* with two parallel guide bars 56 extending between opposing extensions 11*a*, 111*a'*.

For providing the counterforce to the regulating force as exerted by the control element 13, bearings generally designated at 52, 52' are arranged which rest against the roll bodies 48, 48'. Each of the bearings 52, 52' is a sliding block of two supports 54, 54' which are rigidly connected with each other by a plate 53, 53' and are provided with throughholes 50 for slidably guiding the traversing guide bars 56. At their facing sides, the supports 54, 54' are provided with opposing boreholes 51 to retain respective compression springs 55 which exert the counterforce to the regulating force exerted by the control element 13. Preferably, the supports 54, 54' are provided with wear-resistant contact surfaces (sliding coating) upon which the spring forces are slidingly transmitted to the rolls 2, 4 and from the journals thereof to the bearing 11, 11'.

It is certainly possible to substitute the described compression springs 55 by e.g. one or several hydraulic pressure cylinders exerting a constant counterforce, or by massive, adjustable pressure bars which could be used as especially "hard" mechanical springs. For reduction of the sliding friction relative to the rotating roll bodies, the supports 54, 54' may be provided with rolling contact bearings instead of the sliding coatings.

The supports 54, 54' of the bearings 52, 52' further accommodate preferably in the section projecting between the rolls 2, 4 opposing spacing measuring probes 57. Each probe 57 provides an individual signal about the roll clearence and transmits the signal to a summation amplifier (not shown) which delivers a signal about the width of gap 5. The control loop is not illustrated in FIG. 7 in detail as it corresponds to the control loop as described in the embodiment with regard to FIGS. 5 and 6. Only the hydraulic pressure line 32 which communicates via the control valve to the pressure source, and line 21 through which the actual value is transmitted from each probe to the summation amplifier are illustrated.

It should be noted that the use of hydraulic control cylinder devices is especially preferable for fast running rolls while in the event of slowly running rolls, the use of adjusting spindles driven by an electromotor is proposed as control elements and should be considered within the scope of the invention.

While the invention has been illustrated and described as embodied in a Rolling stand, it is not intended to be limited to the details shown since various modifications and structural changes may be made without departing in any way from the spirit of the present invention.

What is claimed as new and desired to be protected by Letters Patent is set forth in the appended claims: I claim:

1. A rolling stand, comprising:

a housing;

a stationary roll supported in said housing and having a journal projecting at each side thereof;

at least one movable roll arranged in spaced apart relationship to said stationary roll so as to define a gap therebetween and having journal projecting at each side thereof;

first bearing means for supporting said journals of said stationary roll and said movable roll;

second bearing means adjacent said first bearing means and acting on said stationary roll and said movable roll; and control means for adjusting the width of said gap by shifting said movable roll relative to said stationary roll, said control means acting solely between said first and second bearing means to define a closed control system and including a control element arranged between said first bearing means for exerting a force to adjust said gap between said stationary roll and said movable roll and a work element arranged between said second bearing means and acting as counterforce in opposition to the force exerted by said control element for prestressing said movable roll relative to said stationary roll so as to allow precise adjustment of said gap and compensation of any bearing play.

2. A rolling stand as defined in claim 1 wherein said first bearing means includes two radial bearings between which said control element is arranged and acts on said radial bearings, and wherein said second bearing means includes two further radial bearings between which said work element is arranged and acts on said further radial bearings.

3. A rolling stand as defined in claim 2 wherein said control element is a pressure fluid operated cylinder-piston unit, with a cylinder connected to one of said radial bearings of said first bearing means and with a piston mounted to said other one of said radial bearings of said first bearing means.

4. A rolling stand as defined in claim 1, and further comprising restriction means cooperating with said control element for limiting the force exerted by said control element onto said one radial bearing to a maximal admissible value.

5. A rolling stand as defined in claim 4 wherein said restriction means is a pressure relief valve controlling pressure supply to said control element.

6. A rolling stand as defined in claim 2 wherein said work element is a spring unit arranged between said radial bearings of said second bearing means for compensating any bearing play during adjustment by said control element.

7. A rolling stand as defined in claim 3 wherein said control means further includes a pressure control unit actuating said control element for adjusting the width of said gap.

8. A rolling stand as defined in claim 7 wherein said pressure control unit includes a control valve operatively connected to said cylinder of said control element, a pump unit connected to said control valve and a comparator receiving information about the actual value with respect to the width of said gap and a desired value, said comparator after comparing the actual value of the width with the desired value acting on said control valve to adjust said control element.

9. A rolling stand as defined in claim 8 wherein said pump unit is an adjustable pressure fluid pump.

10. A rolling stand as defined in claim 6 wherein said spring unit defining said work element includes a compression spring.

11. A rolling stand as defined in claim 6 wherein each of said radial bearings of said second bearing means is provided with guide bores, and further comprising guide bars slidably received in said guide bores and extending parallel to each other for connecting said radial bearings of said second bearing means.

12. A rolling stand as defined in claim 11 wherein said spring unit includes a support slidably guided along said guide bars and including extensions projecting in contactless manner between said stationary roll and said movable roll; and further comprising non-contacting measuring elements accommodated in said extensions.

13. A rolling stand as defined in claim 12 wherein said radial bearings of said second bearing means include lateral extensions, said spring unit including four compression springs coiled about said guide bars and having one end bearing against said lateral extensions and another end abutting said support for approximately centrally positioning said support, and further comprising stop members arranged at said radial bearings of said second bearing means and opposing said support for limiting the width of said gap between said stationary roll and said movable roll.

14. A rolling stand as defined in claim 2 wherein said radial bearings of said second bearing means are sliding blocks supported by said stationary roll and said movable roll.

15. A rolling stand as defined in claim 14 wherein each of said sliding blocks includes two supports bearing against said stationary roll and said movable roll, and a plate rigidly supporting said supports, and further comprising guide bars extending parallel to each other between said stationary roll and said movable roll for slidably guiding said sliding blocks.

16. A rolling stand as defined in claim 14, and further comprising measuring elements accommodated in said supports and opposing each other in pairs for determining the clearance between said stationary roll and said movable roll.

* * * * *